US009089039B2

(12) United States Patent
Lauer et al.

(10) Patent No.: US 9,089,039 B2
(45) Date of Patent: Jul. 21, 2015

(54) PARTICLE ACCELERATION DEVICES WITH IMPROVED GEOMETRIES FOR VACUUM-INSULATOR-ANODE TRIPLE JUNCTIONS

(71) Applicants: Eugene J. Lauer, Pleasanton, CA (US); Mark A. Lauer, Pleasanton, CA (US)

(72) Inventors: Eugene J. Lauer, Pleasanton, CA (US); Mark A. Lauer, Pleasanton, CA (US)

( * ) Notice: Subject to any disclaimer, the term of this patent is extended or adjusted under 35 U.S.C. 154(b) by 23 days.

(21) Appl. No.: 14/198,340

(22) Filed: Mar. 5, 2014

(65) Prior Publication Data

US 2014/0184055 A1 Jul. 3, 2014

Related U.S. Application Data

(60) Provisional application No. 61/922,010, filed on Dec. 30, 2013.

(51) Int. Cl.

| | |
|---|---|
| ***H05H 7/18*** | (2006.01) |
| ***H01J 19/42*** | (2006.01) |
| ***H01J 21/34*** | (2006.01) |

(Continued)

(52) U.S. Cl.

CPC *H05H 7/18* (2013.01); *H01J 19/42* (2013.01); *H01J 19/48* (2013.01); *H01J 21/18* (2013.01); *H01J 21/34* (2013.01); *H05H 7/00* (2013.01); *H01J 21/06* (2013.01)

(58) Field of Classification Search

CPC ..... H05H 7/18; H05H 7/00; H05H 3/06; H05H 3/00; H05H 1/54; H05H 15/00; H05H 9/00; H05H 9/005; H05H 5/00; H05H 7/14; H05H 5/02; H01J 19/00; H01J 19/28; H01J 19/30; H01J 19/38; H01J 19/42; H01J 19/44; H01J 19/48; H01J 21/02; H01J 21/06; H01J 21/18; H01J 21/34

USPC ..... 313/359.1, 361.1, 106–107

See application file for complete search history.

(56) References Cited

U.S. PATENT DOCUMENTS

| | | | |
|---|---|---|---|
| 4,879,518 | A | 11/1989 | Broadhurst |
| 5,742,471 | A | 4/1998 | Barbee, Jr. et al. |

(Continued)

OTHER PUBLICATIONS

Anderson, R.A., "Review of Surface Flashover Theory," Proceedings of the XIVth International Symposium on Discharges and Electrical Insulation in Vacuum, Jan. 1990, pp. 1-15.

(Continued)

*Primary Examiner* — Anne Hines
*Assistant Examiner* — Jose M Diaz
(74) *Attorney, Agent, or Firm* — Mark Lauer; Silicon Edge Law Group LLP

(57) ABSTRACT

For high-voltage devices such as particle accelerators, novel geometries for a triple-junction at which an insulator, an anode and a vacuum meet are disclosed. A singularity in the electric field at the triple-junction is eliminated, reducing dielectric flashover and allowing the devices to operate at higher voltages without breakdown. In one aspect, such a device includes a cathode, an anode having an anode surface exposed to a vacuum, and a dielectric body disposed between the cathode and anode, the dielectric body having a dielectric surface that is exposed to the vacuum, wherein the dielectric surface and the anode surface approach each other such that an angle measured across the vacuum between the dielectric surface and the anode surface decreases with decreasing distance between the dielectric surface and the anode surface until the dielectric surface and the anode surface meet and are parallel.

20 Claims, 5 Drawing Sheets

(51) Int. Cl.

| | |
|---|---|
| ***H01J 21/18*** | (2006.01) |
| ***H01J 19/48*** | (2006.01) |
| ***H05H 7/00*** | (2006.01) |
| *H01J 21/06* | (2006.01) |

(56) References Cited

U.S. PATENT DOCUMENTS

| | | | | |
|---|---|---|---|---|
| 5,811,944 | A | 9/1998 | Sampayan et al. | |
| 5,821,705 | A | 10/1998 | Caporaso et al. | |
| 5,965,971 | A * | 10/1999 | Karpov | 313/309 |
| 7,710,051 | B2 | 5/2010 | Caporaso et al. | |
| 2002/0047545 | A1* | 4/2002 | Paulus et al. | 315/111.61 |
| 2010/0078198 | A1 | 4/2010 | Harris et al. | |
| 2011/0285283 | A1* | 11/2011 | Heid | 315/5 |
| 2013/0106316 | A1 | 5/2013 | Caporaso et al. | |
| 2014/0265940 | A1 | 9/2014 | Caporaso et al. | |

OTHER PUBLICATIONS

Waldron, W., et al., "Electrical Breakdown Studies With Mycalex Insulatiors," Proceedings of the 2003 Particle Accelerator Conference, May 2003, pp. 1171-1173.

Takuma, Tadasu et al., "Electric Fields in Composite Dielectrics and their Applications." Aug. 2010.

Sampayan, S., et al., "High Gradient Insulator Technology for the Dielectric Wall Accelerator," Particle Accelerator Conference and International Conference on High-Energy Accelerators, Dallas, Texas, May 1-5,1995, pp. 1269-1271.

Nunnally, W.C., et al. "Investigation of Vacuum Insulator Surface Dielectric Strength with Nanosecond Pulses," submitted to 2003 Pulsed Power Conference, Dallas, Texas, Jun. 15-18, 2003, 6 pages.

Glock, W.R., et al., "Pulsed High-Voltage Flashover of Vacuum Dielectric Interfaces," Laboratory of Plasma Studies, Cornell University, Ithaca, New York, Aug. 1969, 78 pages.

Stygar, W.A., et al., "Improved design of a high-voltage vacuum-insulator interface." Physical Review Special Topics—Accelerators and Beams, vol. 8, 050401, May 2005, 16 pages.

Chung, M.S., et al., "Theoretical analysis of the enhanced electric field at the triple junction." J.Vac. Scl. Technol. B 22(3), May/Jun. 2004, pp. 1240-1243.

Pillai, A.S. et al., "Improved performance of cylindrical solid insulators with concave curved edges in vacuum," IEEE Transactions on Power Apparatus and Systems, Sep. 1984, pp. 2418-2427.

Pillai, A.S. et al., "Surface flashover of solid insulators in atmospheric air and in vacuum," J. Appl. Phys. 58(1) Jul. 1, 1985.

Pillai, A.S. et al., "Electric Field Distribution at Solid Insulator-Vacuum Interface of Different Electrode-Insulator Geometries," EEE Transactions on Electrical Insulation, vol. EI-19 No. 6, Dec. 1984, pp. 502-511.

* cited by examiner

PARTICLE ACCELERATION DEVICES WITH IMPROVED GEOMETRIES FOR VACUUM-INSULATOR-ANODE TRIPLE JUNCTIONS

CROSS-REFERENCE TO RELATED APPLICATION

This application claims the benefit under 35 U.S.C. §119 of Provisional Application No. 61/922,010, filed by the present inventors on Dec. 30, 2013, which is incorporated herein by reference.

BACKGROUND

Electrical breakdown on surfaces of insulators was perhaps first discovered by German scientist Georg Licthenberg in about 1777, and treelike patterns evidencing such breakdown are sometimes called Lichtenberg figures.

Dielectric breakdown in high-voltage vacuum applications has been a problem for half a century, as the breakdown can limit the maximum voltage and result in catastrophic failure of expensive and complicated devices such as particle accelerators. Conventional linear particle accelerators at that time included a cylindrical insulator that separated a flat anode and a flat cathode, with the interior chamber evacuated to prevent collisions between the particles and gas molecules. The angle between the cathode and the dielectric surface exposed to the vacuum was at 90°, and the angle between the anode and the dielectric surface exposed to the vacuum was at 90°. A phenomenon called "flashover" was known to occur along the dielectric surface, which created a conductive path between the anode and the cathode and destroyed such devices.

About fifty years ago it was discovered that sloping the surface of the dielectric so that the angle between the cathode and the dielectric surface exposed to the vacuum was obtuse and the supplementary angle between the anode and the dielectric surface exposed to the vacuum was acute allowed for higher breakdown voltages. For example, in a paper from 1969 entitled "Pulsed High-Voltage Flashover of Vacuum Dielectric Interfaces," Glock et al. attribute the discovery that cone-shaped insulator surfaces offered improvements in breakdown voltage to Smith, "Pulse Breakdown of Insulator Surfaces in a Poor Vacuum," Proc. of the International Symposium on Insulation of High Voltages in Vacuum, (1964) and Shannon et al., "Insulation of High Voltage Across Insulators in Vacuum" Vacuum Science Tech. 2:234 (1965). Since that time, conventional high voltage particle accelerators have typically employed dielectric surfaces that are angled at 45° to the cathode and anode surfaces. Various reports have confirmed that employing a dielectric surface that is sloped so that the angle between that surface and the cathode surface across the vacuum is obtuse provides higher breakdown voltages.

While sloping the dielectric surface helped, it did not solve the problem of flashover. Over twenty years ago, in an article entitled "Review of Surface Flashover Theory," in Proceedings of the XIVth International Symposium on Discharges and Electrical Insulation in Vacuum, Santa Fe, N. Mex. (1990) at p. 311, R. A. Anderson reviewed various studies and theories of the flashover problem. Anderson's review states the following: "Surface flashover appears to comprise at least two distinct phenomena which can be distinguished as being cathode-initiated or anode-initiated, with the former having received by far the most attention. Several models describing cathode-initiated flashover have been built on the pioneering work of Boersch and coworkers, published in 1963, and credit the breakdown mechanism to the action of an intense secondary-electron-emission avalanche on the insulator surface. Other researchers consider the electron avalanche to be only partially, if at all, responsible, and invoke various hot-carrier effects in the insulator bulk, the surface interfacial region, or in a layer of gas adsorbed on the insulator surface. Anode-initiated flashover, which contends with the cathode-initiated variety for the breakdown of insulators of conventional design, is thought to involve bulk breakdown in a way related to treeing failure."

Regarding anode-initiated flashover, Anderson notes that flashover still occurs when the electric field is directed into the insulator surface at angles approaching normal incidence (as with conical insulators having large positive angles), where secondary-emission avalanches would be difficult to initiate. Anderson points to flashover with conical insulators having large positive angles as leading to his theory of anode-initiated flashover.

U.S. Pat. No. 5,821,705 to Caporaso et al., filed in 1996, teaches reducing dielectric flashover by providing isolated conductive layers that are alternated with insulator layers, but this approach has also not solved the problem of dielectric flashover.

About ten years ago, Chung et al. calculated, in an article entitled "Theoretical Analysis of the Enhanced Electric Field at the Triple Junction," J. Vac. Sci. Technol. 22(3), May/June (2004), various two-dimensional triple junction geometries at which a conductor, a dielectric and a vacuum meet. Among other things, Chung et al. show that for a flat conductor geometry the electric field at such a triple point approaches infinity for an angle measured across the vacuum that is between 0° and 90°, whereas for such an angle that is greater than 90° and less than 180° no such singularity exists. One result that can be deduced from Chung et al. is that sloping the dielectric surface to create an obtuse angle at the cathode triple junction may have alleviated one type of flashover but created a singularity at the anode triple junction that could cause another mechanism of failure.

As mentioned above, a model of anode-initiated flashover was developed by R. A. Anderson in the 1970's. The mechanism proposed by Anderson is summarized in an article by Styger et al. entitled "Improved design of a high-voltage vacuum-insulator interface," Phys. Rev. ST Accel. Beams 8, 050401 (2005), of which Anderson is a co-author, as follows: "At a sufficiently high voltage, the flashover of a 45° interface initiates at the anode junction due to emission of electrons from the insulator (citations omitted). The emission increases the electric field at the insulator surface, which in turn precipitates bulk dielectric-breakdown events at the surface. The events branch across the surface until they reach the cathode and the flashover is complete." Styger et al. also note that the use of an anode plug to shield the anode triple junction was first proposed by D. H. McDaniel in 1975, and Styger et al. report some improvement in dielectric breakdown using such a shield.

Similarly, in an article entitled "Electron Avalanche Model of Dielectric-Vacuum Surface Breakdown," Journal of Applied Physics, December 2007, Vol. 102 Issue 11, p113306, E. J. Lauer proposed a process by which an electron avalanche may occur, beginning near a triple point at which a dielectric meets an anode at a 45° angle. E. J. Lauer, one of the present inventors, theorized that the relatively high electric field at the anode triple junction caused field emission of electrons from the dielectric near the anode triple junction, which resulted in positive charge on the dielectric in the vicinity of the anode triple junction, which in turn caused electron avalanching to commence on the dielectric-vacuum interface. Thus, according to this theory also, providing a 45° slope to the dielectric surface to alleviate the problem of dielectric flashover that initiated at the cathode triple junction appears to have created a different type of flashover that initiates at the anode triple junction.

In short, a solution to the problem of dielectric breakdown at a vacuum interface under high voltage has eluded researchers for decades.

SUMMARY

In one embodiment, a device is disclosed comprising: a cathode having a cathode surface; an anode having an anode surface that is exposed to a vacuum; and a dielectric body disposed between the anode and the cathode, the dielectric body having a dielectric surface that is exposed to the vacuum; wherein the dielectric surface and the anode surface approach each other such that an angle measured across the vacuum between the dielectric surface and the anode surface decreases with decreasing distance between the dielectric surface and the anode surface until the dielectric surface and the anode surface meet and are parallel.

In one embodiment, the dielectric surface curves to meet the anode surface. In one embodiment, the anode surface curves to meet the dielectric surface.

This brief summary does not purport to limit the invention, which is disclosed in detail below and is defined by the appended claims and their equivalents.

DETAILED DESCRIPTION

Figure 1:
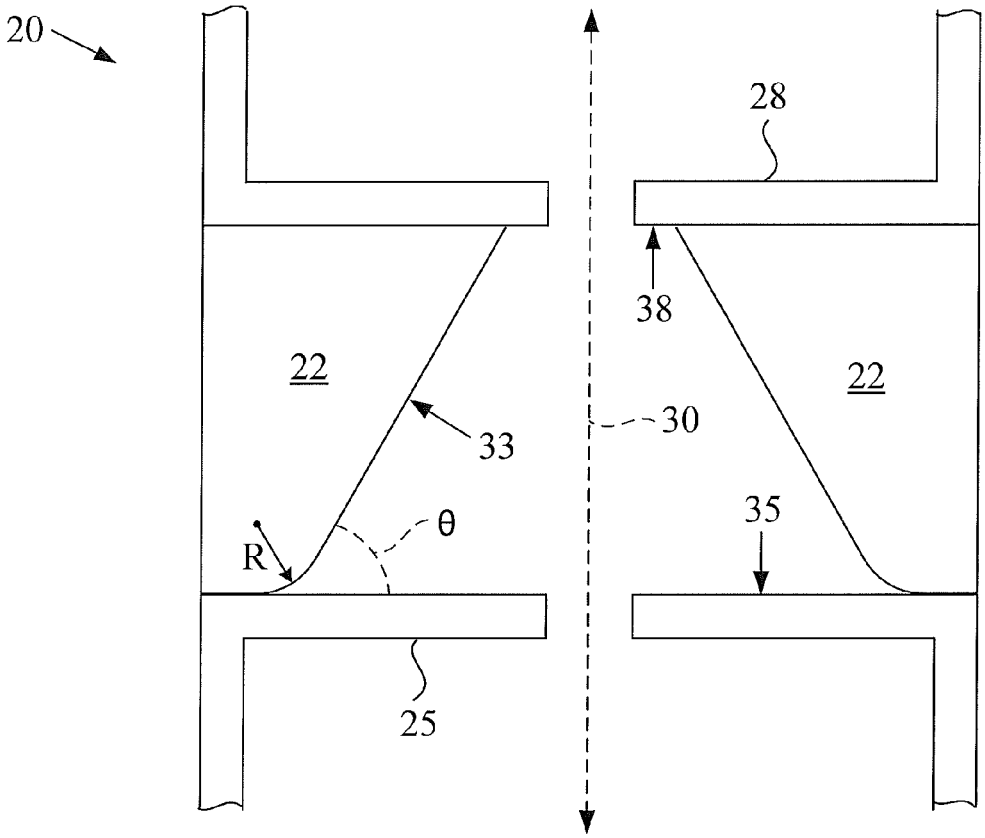
FIG. 1 is a cross-sectional view of a device having a dielectric body disposed between an anode and a cathode, with a surface of the dielectric body that is exposed to a vacuum and that curves to meet the anode at a zero contact angle.

FIG. 1 is a cross-sectional view of one embodiment of a device 20 having a dielectric body 22 disposed between an anode 25 and a cathode 28. In this embodiment, the anode 25 has a surface 35 that is flat, and the cathode 28 has a surface 38 that is flat. A vacuum exists in a cavity between the dielectric body 22, anode 25 and cathode 28. The dielectric body 22 has a surface 33 that is exposed to the vacuum and that curves to be in flat contact with the anode surface 35. A radius of curvature R of the convex portion of the dielectric surface 33 that curves to meet the anode surface 35 in one example may be in a range of between a few millimeters and several centimeters. Alternatively, the radius of curvature R of the convex portion of the dielectric surface 33 that curves to meet the anode surface 35 in one example may be in a range between one-quarter and one-twentieth of the minimum distance between the cathode and the anode.

The device 20 in the embodiment shown in FIG. 1 is symmetric about an axis 30 that is normal to the anode surface 35, and the dielectric surface 33 that is exposed to the vacuum is essentially a truncated cone that is flared outward at its large opening. The device 20 may appear to be generally cylindrical when viewed from the outside. In one embodiment, the device 20 may be used as a particle accelerator. For example, the device 20 may accelerate positive ions substantially along the axis 30 in a direction from anode to cathode. Alternatively in this embodiment, the device 20 may accelerate negative ions or electrons substantially along the axis 30 in a direction from cathode to anode. In addition, the device may operate with a voltage between the cathode and anode of at least 10 kV, and a pressure of less than $10^{-4}$ torr. In general, however, the teachings of this disclosure may be employed in any device wherein a triple junction between an anode, a dielectric and a vacuum would otherwise suffer from a relatively high electric field at the triple junction.

An angle θ between the anode surface 35 and the dielectric surface 33 in this embodiment is less than 90° and greater than 40°, and is constant for a portion of the dielectric surface 33 that is closest to the cathode surface 38. In a portion of the dielectric surface 33 that is close to the anode surface 35, the angle θ decreases as the distance between the dielectric surface 33 and the anode surface 35 decreases. At the point of contact between the dielectric surface 33 and the anode surface 35 the angle θ is essentially zero. Applicant believes that the relatively high electric field at the triple junction between the anode, dielectric and vacuum has been reduced if not eliminated. In this case, the electric field strength may be increased without an electron avalanche being initiated at either the cathode triple junction or the anode triple junction. Moreover, because the relatively high electric field at the triple junction between the anode 25, dielectric 22 and vacuum has been reduced or eliminated, the angle θ near the cathode may be made greater than the conventional angle of 45° without inducing electron avalanche along the surface 33.

Figure 2:
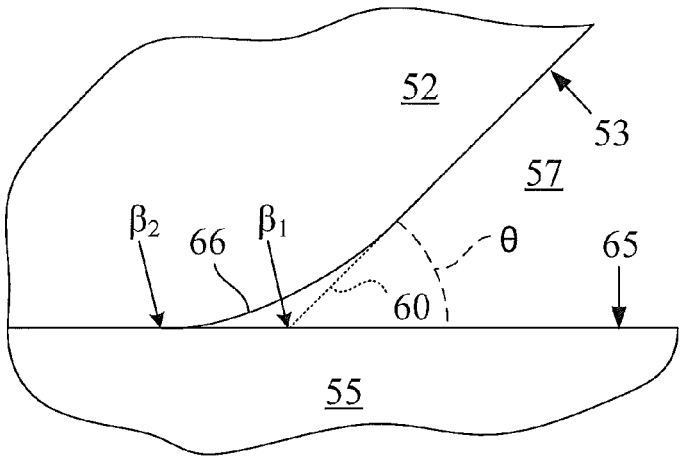
FIG. 2 is a cross-sectional view of a comparison between a conventional dielectric-metal-vacuum triple junction and a dielectric-metal-vacuum triple junction of an embodiment of the present disclosure.

Referring now to FIG. 2, a comparison of two triple junctions between a dielectric 52, metal anode 55 and vacuum 57 are shown. In the first, a conventional anode-dielectric-vacuum triple junction is shown by the straight dotted line 60, which represents a straight dielectric surface 53 that meets the metal anode surface 65 at an angle $\beta_1$ of 135°, so that the supplementary angle θ across a vacuum 57 between the dielectric surface 53 and the anode surface 65 is 45°. In the second, a novel anode-dielectric-vacuum triple junction is shown by the curved solid line 66, which represents a curved portion of dielectric surface 53 that meets the metal anode 55 at an angle $\beta_2$ of 180°. The dielectric surface 66 approaches the anode surface 65 asymptotically, and the angle across the vacuum between the dielectric surface 66 and the anode surface 65 decreases with decreasing distance between the dielectric surface 66 and the anode surface 65.

Figure 5:
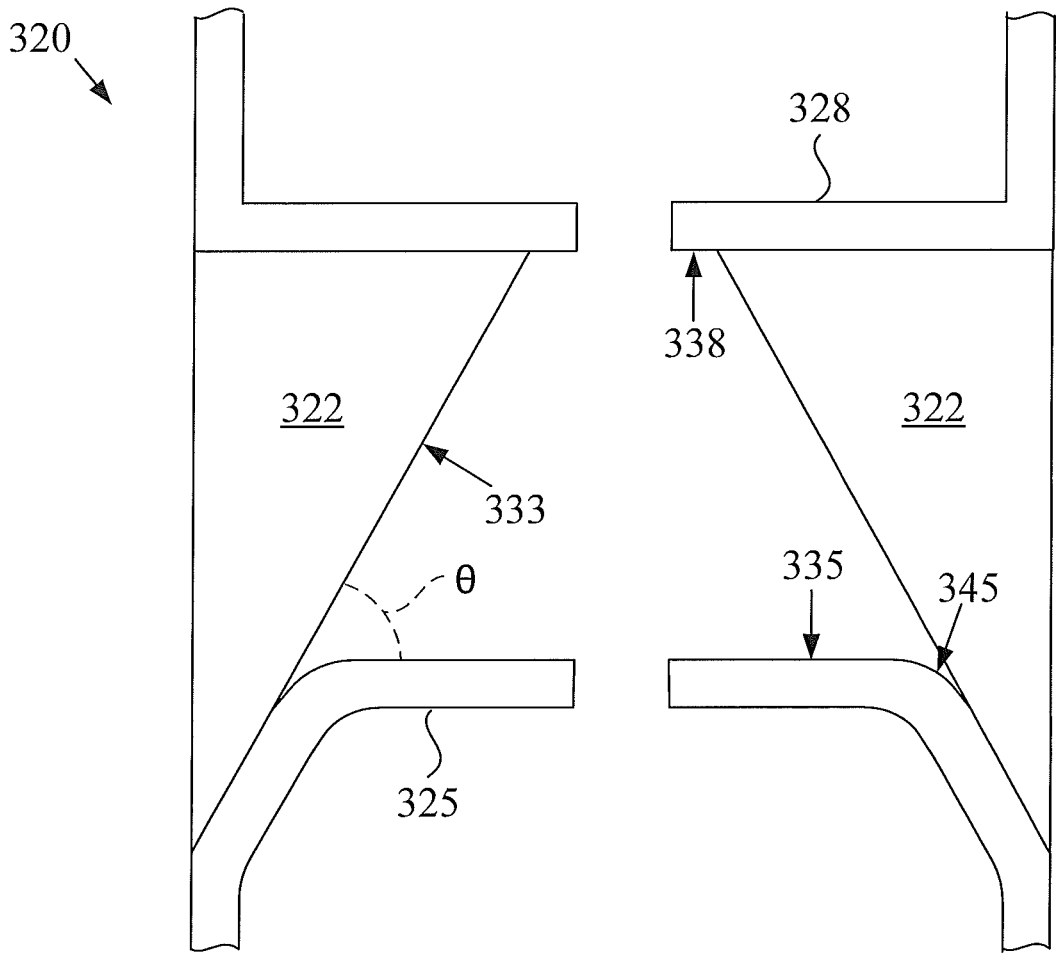
FIG. 5 is a cross-sectional view of a device having a dielectric body disposed between an anode and a cathode, with a surface of the anode having a flat portion and a portion that curves to meet the dielectric surface at a zero contact angle.

As disclosed in Chung et al., supra, a two-dimensional electric field strength E depends upon the radial distance r from the triple junction as $E \alpha r \gamma^{-1}$. Referring to FIG. 5 of Chung et al., and assuming a dielectric constant of $\in=5.7$, for $\beta_1=135°$, $\gamma=0.76$ and $E \alpha 1/r^{0.24}$, which diverges at r=0. In other words, for these parameters the electric at the anode triple junction approaches infinity. In fact, FIG. 5 of Chung et al. show that the electric field approaches infinity at the anode triple junction for all angles of β greater than 90° and less than 180°. Moreover, the singularity is more pronounced for insulators having a high dielectric constant and especially for angles of β greater than 135° and less than 180°.

As theorized by Lauer, supra, the relatively high electric field at the anode triple junction causes field emission of electrons from the dielectric near the anode triple junction, which results in positive charge on the dielectric in the vicinity of the anode triple junction, which in turn causes electron avalanching to commence on the dielectric-vacuum interface.

For $\beta_2$=180°, however, γ=1 and E is independent of r. That is, for this geometry, there is essentially no field enhancement at the triple junction. The anode-cathode potential difference can be increased until bulk dielectric breakdown occurs at a much higher voltage.

Figure 3:
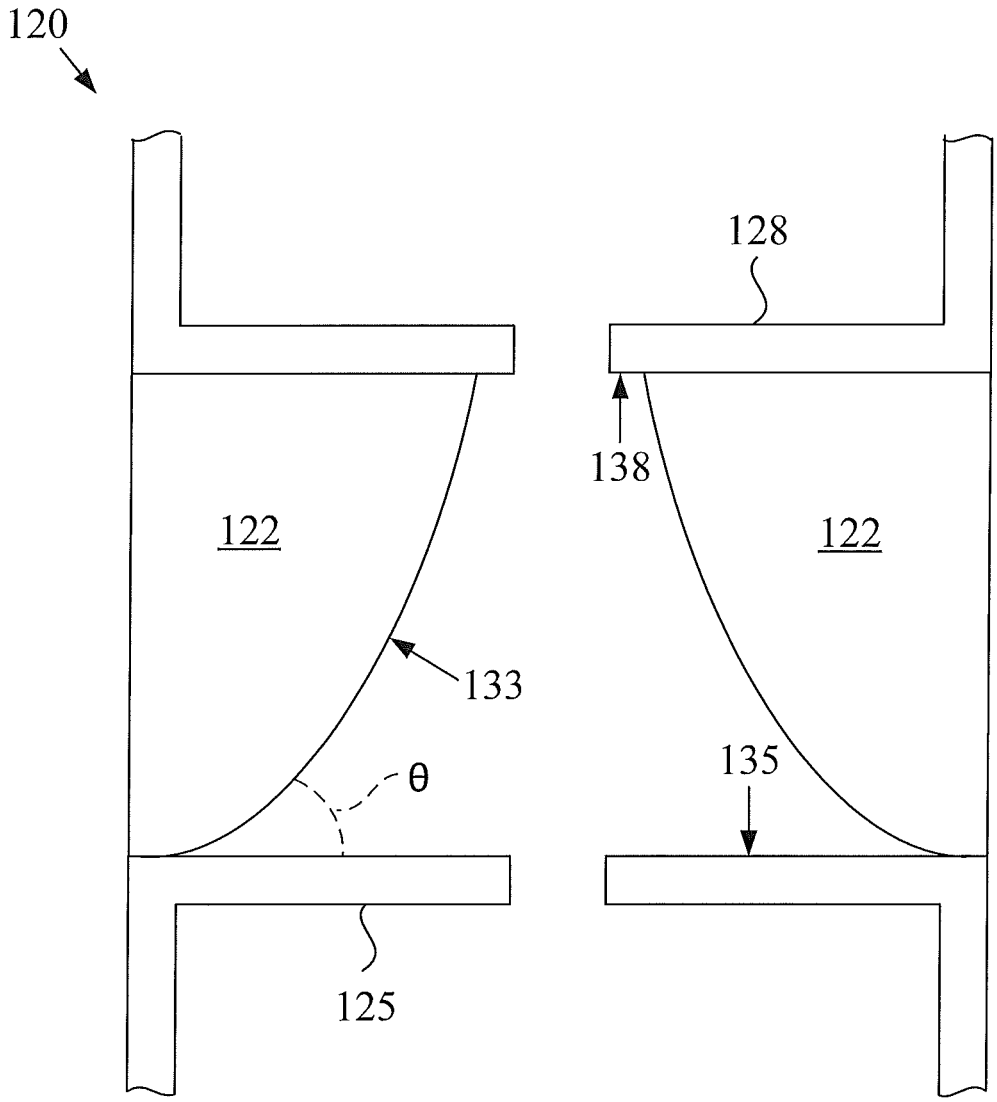
FIG. 3 is a cross-sectional view of a device having a dielectric body disposed between an anode and a cathode, with a surface of the dielectric body that is exposed to vacuum being substantially trumpet-shaped and meeting the anode at a zero contact angle.

FIG. 3 is a cross-sectional view of an embodiment of a device 120 having a dielectric body 122 disposed between an anode 125 and a cathode 128. In this embodiment, the anode 125 has a surface 135 that is flat, and the cathode 128 has a surface 138 that is flat. A vacuum exists in a cavity between the dielectric body 122, anode 125 and cathode 128. The dielectric body 122 has a surface 133 that is exposed to the vacuum and that curves to meet the anode surface 135. The device 120 is symmetric about an axis that is normal to the anode surface 135, and the dielectric surface 133 that is exposed to vacuum is substantially trumpet-shaped.

An angle θ between the anode surface 135 and the dielectric surface 133 is less than 90°, beginning at zero degrees at the anode surface and increasing as the dielectric surface 133 approaches the cathode surface 138. In this embodiment, the angle θ changes more rapidly near the anode surface 135 than near the cathode 128. The dielectric surface 133 curves to approach the anode surface 135 asymptotically, and the angle across the vacuum between the dielectric surface 133 and the anode surface 135 decreases with decreasing distance between the dielectric surface 133 and the anode surface 135. Because the relatively high electric field at the triple junction between the anode 125, dielectric 122 and vacuum has been reduced or eliminated, the angle θ near the cathode may be made greater than the conventional angle of 45° without inducing electron avalanche along the surface 133.

Figure 4:
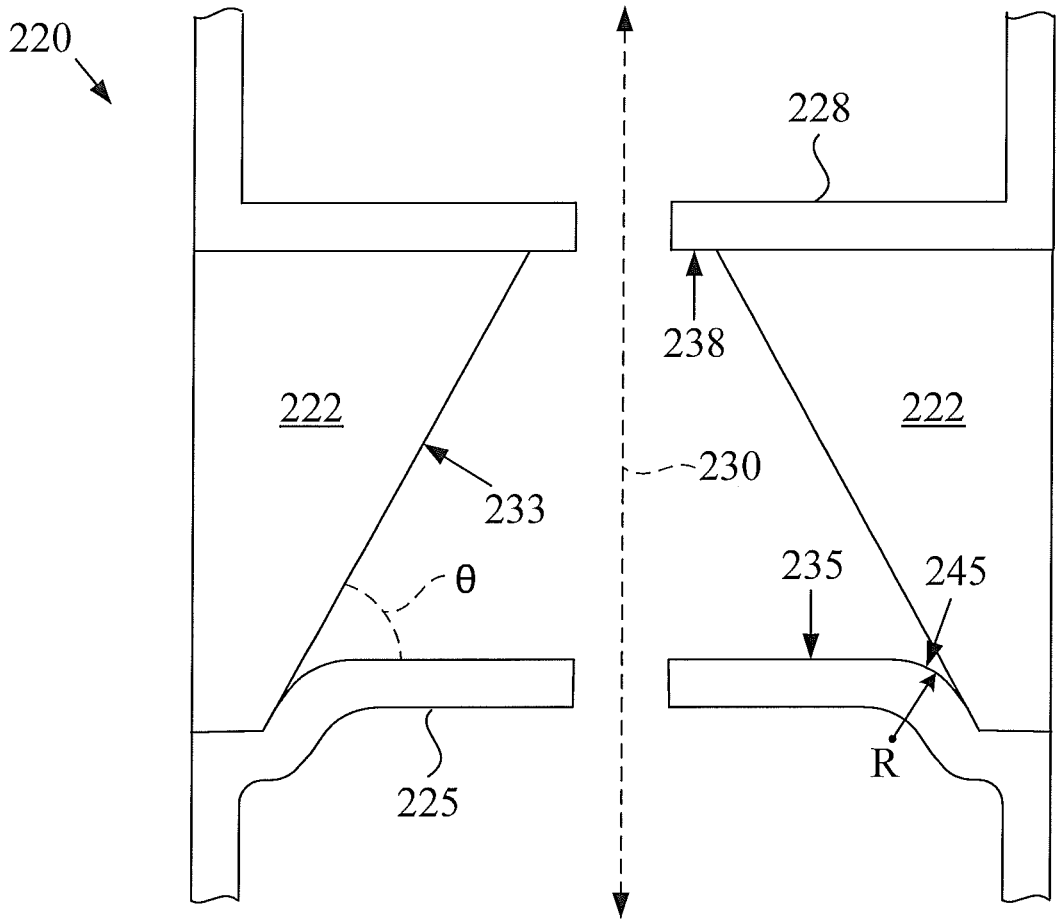
FIG. 4 is a cross-sectional view of a device having a dielectric body disposed between an anode and a cathode, with a surface of the anode curving to meet the dielectric surface at a zero contact angle.

FIG. 4 is a cross-sectional view of an embodiment of a device 220 having a dielectric body 222 disposed between an anode 225 and a cathode 228. The dielectric body 222 has a dielectric surface 233 that is exposed to a vacuum. In this embodiment, the cathode 228 has a surface 238 that is flat, and the anode 225 has a surface that has a first portion 235 that is flat and a second portion 245 that curves to meet the dielectric surface 233. An angle θ measured across the vacuum between the dielectric surface 233 and the second portion of the anode surface 245 decreases with decreasing distance between the dielectric surface and the anode surface. The angle between the cathode surface 238 and the dielectric surface 233 remains constant until the point of contact between the dielectric surface 233 and the anode surface 245, and the dielectric body 222 sits on a shoulder of the anode 225 in this embodiment. In one embodiment, the anode surface has a radius of curvature R that is in a range between three millimeters and eight centimeters. In one embodiment, the dielectric surface 233 is substantially conical, and the anode surface 235 is substantially annular about an axis 230.

FIG. 5 is a cross-sectional view of an embodiment of a device 320 having a dielectric body 322 disposed between an anode 325 and a cathode 328. The dielectric body 322 has a dielectric surface 333 that is exposed to a vacuum. In this embodiment, the cathode 328 has a surface 338 that is flat, and the anode 325 has a surface that has a first portion 335 that is flat and a second portion 345 that curves to meet the dielectric surface 333. An angle θ measured across the vacuum between the dielectric surface 333 and the second portion of the anode surface 345 decreases with decreasing distance between the dielectric surface and the anode surface. The angle between the cathode surface 338 and the dielectric surface 333 remains constant in this embodiment, and the dielectric body is generally cylindrical with a conical inner surface 333.

Figure 6:
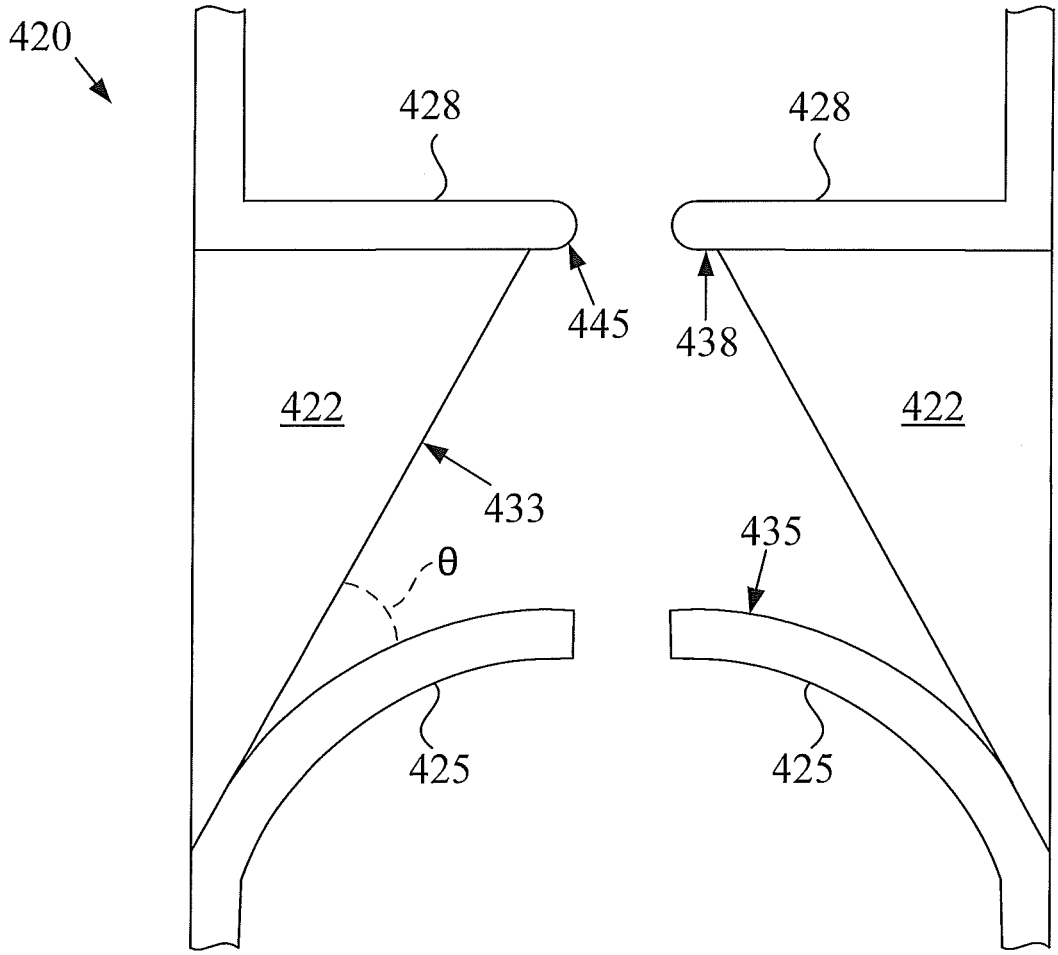
FIG. 6 is a cross-sectional view of a device having a dielectric body disposed between an anode and a cathode and having a surface exposed to vacuum, with a surface of the anode curving to meet the dielectric surface at a zero contact angle.

FIG. 6 is a cross-sectional view of an embodiment of a device 420 having a dielectric body 422 disposed between an anode 425 and a cathode 428. The dielectric body 422 has a dielectric surface 433 that is exposed to a vacuum. In this embodiment, the cathode 428 has a surface 438 that is flat, and the anode 425 has a surface 435 that curves to meet the dielectric surface 433. An angle θ measured across the vacuum between the dielectric surface 433 and the anode surface 445 decreases with decreasing distance between the dielectric surface and the anode surface. The angle between the cathode surface 438 and the dielectric surface 333 remains constant in this embodiment, and the dielectric body is generally cylindrical with a conical inner surface 433. In this embodiment, the cathode 428 has an edge 445 that is rounded, which may help to reduce electron emission from the cathode 428.

The embodiments shown in FIG. 4, FIG. 5 and FIG. 6 may have an additional advantage in that the anode triple junction is located further than the flat portion of the anode from the cathode, further reducing the field strength at the anode triple junction.

Although not explicitly illustrated in the embodiments shown above, it is also possible that both the anode surface and the dielectric surface curve to meet each other while an angle measured across the vacuum between the dielectric surface and the anode surface decreases with decreasing distance between the dielectric surface and the anode surface.

The foregoing description of exemplary embodiments of the invention has been presented for the purposes of illustration and description. It is not intended to be exhaustive or to limit the invention to the precise form disclosed. For example, although examples of particle accelerators are illustrated, other apparatuses that may encounter problems from dielectric breakdown at triple junctions of a dielectric, anode and vacuum may also be improved by the present invention. Many modifications and variations are possible in light of the above teaching. It is intended that the scope of the invention be limited not by this description, but rather by the following claims and any equivalents thereof.

The invention claimed is:

1. A device comprising:

a cathode having a cathode surface;

an anode having an anode surface that is exposed to a vacuum; and a dielectric body disposed between the anode and the cathode, the dielectric body having a dielectric surface that is exposed to the vacuum;

wherein the dielectric surface and the anode surface approach each other such that an angle measured across the vacuum between the dielectric surface and the anode surface decreases with decreasing distance between the dielectric surface and the anode surface until the dielectric surface and the anode surface meet and are parallel.

2. The device of claim 1, wherein the dielectric surface curves to meet the anode surface.

3. The device of claim 1, wherein the anode surface curves to meet the dielectric surface.

4. The device of claim 1, wherein:

the anode surface has a flat area that is exposed to the vacuum; and the dielectric surface is symmetric about an axis that is perpendicular to the flat area.

5. The device of claim 1, wherein the dielectric surface has a section in which the angle between the dielectric surface and the anode surface is constant and is greater than forty degrees and less than ninety degrees.

6. The device of claim 1, wherein the dielectric surface is substantially conical.

7. The device of claim 1, wherein the dielectric surface is trumpet-shaped.

8. A device comprising:

a cathode having a cathode surface;

an anode having an anode surface that is flat and exposed to a vacuum; and a dielectric body disposed between the anode and the cathode, the dielectric body having a dielectric surface that is exposed to the vacuum and that curves to meet the anode surface such that an angle measured across the vacuum between the dielectric surface and the anode surface decreases with decreasing distance between the dielectric surface and the anode surface until the dielectric surface and the anode surface are in contact and the angle is zero.

9. The device of claim 8, wherein the dielectric surface has a convex radius of curvature that is in a range between one-quarter and one-twentieth of the minimum distance between the cathode and the anode.

10. The device of claim 8, wherein the dielectric surface has a convex radius of curvature that is in a range between five millimeters and ten centimeters.

11. The device of claim 8, wherein the dielectric surface is symmetric about an axis that is perpendicular to the anode surface.

12. The device of claim 8, wherein the dielectric surface has a section in which the angle between the dielectric surface and the anode surface is constant and is greater than forty degrees and less than ninety degrees.

13. The device of claim 8, wherein the dielectric surface is trumpet-shaped.

14. A device comprising:

a cathode having a cathode surface;

an anode having an anode surface that is exposed to a vacuum; and a dielectric body disposed between the anode and the cathode, the dielectric body having a dielectric surface that is exposed to the vacuum;

wherein the anode surface curves to meet the dielectric surface such that an angle measured across the vacuum between the dielectric surface and the anode surface decreases with decreasing distance between the dielectric surface and the anode surface until the dielectric surface and the anode surface are in contact and the angle is zero.

15. The device of claim 14, wherein the anode surface has a first portion that is flat and a second portion that curves to meet the dielectric surface.

16. The device of claim 15, wherein the second portion of the anode surface has a convex radius of curvature that is in a range between one-quarter and one-twentieth of the minimum distance between the cathode and the anode.

17. The device of claim 15, wherein the second portion of the anode surface has a convex radius of curvature that is in a range between three millimeters and eight centimeters.

18. The device of claim 15, wherein the angle between the dielectric surface and the first portion of the anode surface is greater than forty degrees and less than ninety degrees.

19. The device of claim 14, wherein the dielectric surface is shaped as a truncated cone.

20. The device of claim 14, wherein the anode, the cathode and the dielectric body are part of a particle accelerator.

* * * * *